US010427698B2

(12) United States Patent
McCarthy

(10) Patent No.: US 10,427,698 B2
(45) Date of Patent: Oct. 1, 2019

(54) TRAIN DERAILER PLACEMENT WARNING DEVICE

(71) Applicant: John McCarthy, Bethalto, IL (US)

(72) Inventor: John McCarthy, Bethalto, IL (US)

(73) Assignee: Green Timber Energy, Bethalto, IL (US)

( * ) Notice: Subject to any disclaimer, the term of this patent is extended or adjusted under 35 U.S.C. 154(b) by 226 days.

(21) Appl. No.: 15/417,476

(22) Filed: Jan. 27, 2017

(65) Prior Publication Data

US 2017/0217456 A1 Aug. 3, 2017

Related U.S. Application Data

(60) Provisional application No. 62/288,879, filed on Jan. 29, 2016.

(51) Int. Cl.

| | |
|---|---|
| ***B61K 5/06*** | (2006.01) |
| ***B61L 5/18*** | (2006.01) |
| ***B61L 23/00*** | (2006.01) |

(52) U.S. Cl.

CPC ..... *B61K 5/06* (2013.01); *B61L 5/1809* (2013.01); *B61L 5/189* (2013.01); *B61L 23/00* (2013.01); *B61L 2207/02* (2013.01)

(58) Field of Classification Search

CPC ..... B61K 5/06; B61K 13/00; B61L 5/1809; B61L 5/189; B61L 23/00; B61L 2207/02; B61L 5/107; B61L 29/24; G08B 13/149; G08B 5/38; G08B 13/1409; G08B 13/22; G08B 5/00; G08B 5/006; A47G 29/122

USPC ..... 116/205, 568.1; 340/815.45; 246/220

See application file for complete search history.

(56) References Cited

U.S. PATENT DOCUMENTS

| | | | | |
|---|---|---|---|---|
| 975,922 | A * | 11/1910 | Adams | A63H 19/00 246/217 |
| 1,837,184 | A | 12/1931 | Drillette | |
| 3,085,238 | A | 4/1963 | Lewis | |
| 3,544,960 | A | 12/1970 | Hayes | |
| 4,654,629 | A | 3/1987 | Bezos et al. | |
| 4,754,272 | A | 6/1988 | Illenberg et al. | |
| D304,694 | S | 11/1989 | Goss | |
| 4,942,395 | A | 7/1990 | Ferrari et al. | |
| 5,253,830 | A * | 10/1993 | Nayer | B61L 5/107 246/162 |
| 5,680,033 | A | 10/1997 | Cha | |
| 5,735,492 | A | 4/1998 | Pace | |
| 5,791,605 | A | 8/1998 | Howie, II | |
| 5,839,816 | A | 11/1998 | Varga et al. | |
| 5,954,299 | A | 9/1999 | Pace | |

(Continued)

*Primary Examiner* — Mark T Le

(74) *Attorney, Agent, or Firm* — Sandberg Phoenix & von Gontard PC

(57) ABSTRACT

A derail placement warning system for a railway derailer that automatically generates an alert to inform railway personnel (or others) of the placement of the derailer on a rail of the railway such that the derailer will derail rail traffic over the derailer. The warning system has an electronic circuit with an electric power source, an electronic switch and an electronic alert, and is configured for the switch to automatically activate and turn ON the alert when the derailing component of the derailer is positioned atop a railway rail. The alert comprises one or more of an audible component, a tactile sensation, an olfactory component, a visible light emission, and an electronic transmission.

29 Claims, 9 Drawing Sheets

(56) References Cited

U.S. PATENT DOCUMENTS

| | | | | |
|---|---|---|---|---|
| 6,013,985 | A | 1/2000 | Green et al. | |
| 6,168,120 | B1 * | 1/2001 | Pease | B61L 5/00 246/393 |
| 6,435,459 | B1 | 8/2002 | Sanderson et al. | |
| 6,573,659 | B2 | 6/2003 | Toma et al. | |
| 6,602,021 | B1 | 8/2003 | Kim | |
| 7,018,131 | B2 | 3/2006 | Jordan | |
| 7,075,427 | B1 | 7/2006 | Pace et al. | |
| 7,154,403 | B2 | 12/2006 | Davenport et al. | |
| 7,158,020 | B2 * | 1/2007 | Grady, Jr. | B60Q 7/00 116/63 T |
| 7,300,165 | B2 | 11/2007 | Garcia | |
| 9,031,791 | B2 * | 5/2015 | Nedilko | B61K 9/08 702/14 |
| 2005/0270175 | A1 | 12/2005 | Peddle et al. | |
| 2009/0174542 | A1 | 7/2009 | Gentry et al. | |
| 2009/0256723 | A1 | 10/2009 | Peddle et al. | |

* cited by examiner

TRAIN DERAILER PLACEMENT WARNING DEVICE

CROSS REFERENCE TO RELATED APPLICATIONS

This application claims the benefit of U.S. Provisional Application No. 62/288,879, entitled TRAIN DERAILER PLACEMENT WARNING DEVICE, filed on Jan. 29, 2016. The disclosure of the above application is incorporated herein by reference.

STATEMENT REGARDING FEDERALLY SPONSORED RESEARCH OR DEVELOPMENT

Not applicable.

BACKGROUND OF THE INVENTION

This invention relates generally to a device or system for alerting a train or other movable rail equipment in motion on a set of tracks when said train or rail equipment is in proximity to a derailer positioned on the tracks, and more particularly to a device or system that actively produces a signal to the train or rail equipment passing near the device warning of the proximity of the derailer on the tracks.

In the railroad industry it is often necessary to conduct maintenance or repairs of various sections of rail or tracks. This is particularly relevant in high rail traffic locations, such as for example in rail yards. In addition, sections of track may simply be shut down due to condition or other factors. Further, it is often desirable to prevent the undesired or unauthorized movement of trains or rail cars across particular sections of track at particular times. When sections of track are shut down or need to be blocked from rail traffic, it is a standard procedure to place and engage one or more "derail" or "derailer" devices on the tracks to prevent a train or other rail equipment from traversing those tracks where the derailer is engaged. These derailer devices force the errant train or other rail equipment off of the tracks and onto the ground or onto a side rail beside the tracks at the position of the derailer.

There are several configurations of derailer devices—these include what are generally referred to in the industry as "hinged", "slide" and "portable". All derailers comprise a ramped wedge component that is designed to be positioned over the top of one rail along a section of tracks. This wedge is shaped such that should a locomotive or other rail car traverse the derailer, the wedge will lift the wheels riding on the rail with the derailer and direct those wheels across and over the rail to the ground beside the tracks or onto a platform or other surface adjacent the derailer. "Hinged" and "slide" derailers are "permanent" or "fixed" derailing devices that are attached to the tracks or the ties for extended periods of time. Both include a wedge that may be positioned atop the rail in an "Active" or "ON" or "DERAILING" position, or alternately in one or more other positions not atop the rail, in an "Inactive" or "OFF" or "NON-DERAILING" position. That is, when not in use or engaged, the wedge component of the derailer can be folded or collapsed or moved away from the top of the rail in order to leave the rail unobstructed. For "hinge" derailers, the wedge rotates or pivots about a hinge or pivot pin to move the wedge between the "Active" or "ON" or "DERAILING" position and the "Inactive" or "OFF" or "NON-DERAILING" position. "Slide" derailers, as their name implies utilize a sliding mechanism to move the wedge between the "Active" or "ON" or "DERAILING" position and the "Inactive" or "OFF" or "NON-DERAILING" position. Virtually all "hinge" and "slide" derailer devices can be constructed for manual or automated operation, and can be constructed to operate locally or remotely.

In contrast, "portable" derailers are simply constructed for temporary attachment to the rail with the wedge always configured in the "Active" or "ON" or "DERAILING" position atop the rail. In order to prevent the derailer from being thrown from the track and failing to cause a derail when necessary, "portable" derailers are rigidly secured to the rail with, for example, heavy bolts or clamps.

It is critical that when a derailer is positioned upon a section of tracks with the wedge in the "Active" or "ON" or "DERAILING" position—that is, when the derailer is configured to derail—that rail traffic has adequate notice of such "active" derailer in order to prevent unintended or otherwise unnecessary derailings from occurring along that section of the track. In order to provide a warning of the placement and/or activation of a derailer, regulations require that a blue flag or a blinking blue light must be placed on or near the derailer upon positioning "portable" derailers on the tracks or positioning the wedge of a "permanent" derailer in the "Active" or "ON" or "DERAILING" position.

Unfortunately, this type of warning relies upon workers to properly place the flags or blinking lights and to properly remove or deactivate the derailer when the flags and blue lights have been removed. This is not always the case, and accidental derailings have occurred due to work crews forgetting to remove or deactivate a derailer after removing the flags and blue lights. While some derailers have been designed to incorporate devices that automatically elevate a blue flag upon activation on a section of tracks, and other derailer systems have been devised to allow for remote activation of warning blue lights for the derailers, these improvements still fall short of providing assurance of an active warning whenever a derailer is placed and active on a set of tracks.

It would therefore be desirable to have a device that would automatically provide a warning signal to rail traffic in the vicinity of a derailer that has been activated and positioned on a section of tracks until the derailer has either been deactivated or removed from the tracks. It would further be desirable for such a derailer to be configured to generate the warning signal without the need for any external power to activate the warning signal.

As will become evident in this disclosure, the present invention provides benefits over the existing art.

BRIEF DESCRIPTION OF THE DRAWINGS

The illustrative embodiments of the present invention are shown in the following drawings which form a part of the specification.

Corresponding reference characters indicate corresponding parts throughout the several views of the drawings.

DETAILED DESCRIPTION

Figure 1:
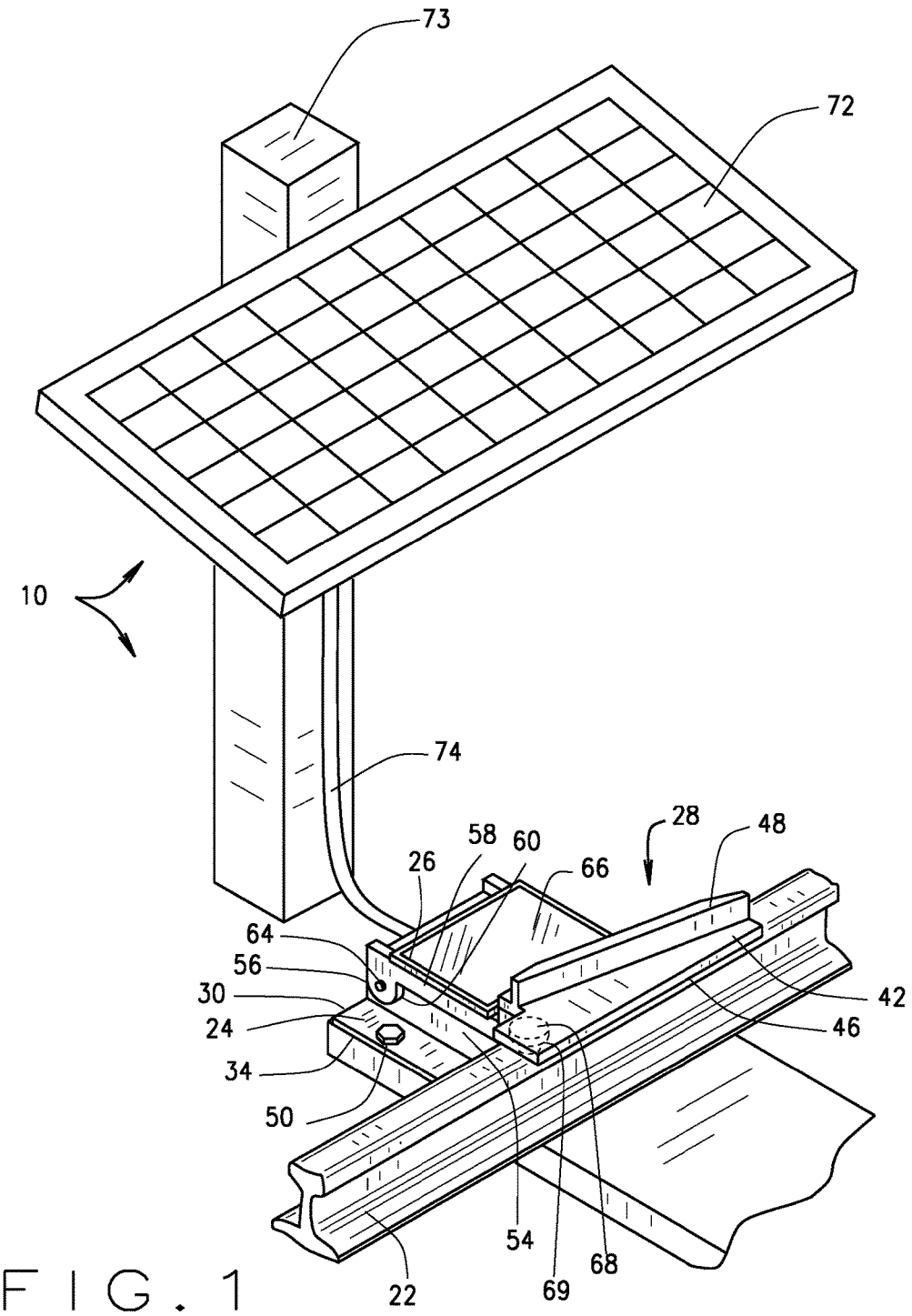
FIG. 1 is a perspective view of a permanent derailer positioned adjacent a section of railway track and incorporating a first embodiment of the present invention, the derailer having an LED panel on a rotatable derail wedge, the LED panel being connected by electric cable to a nearby solar charger mounted on a vertical stake, the wedge shown rotated to engaged the top of the railway track in an "active" (a/k/a "ON" or "DERAILING") position.
Figure 2:
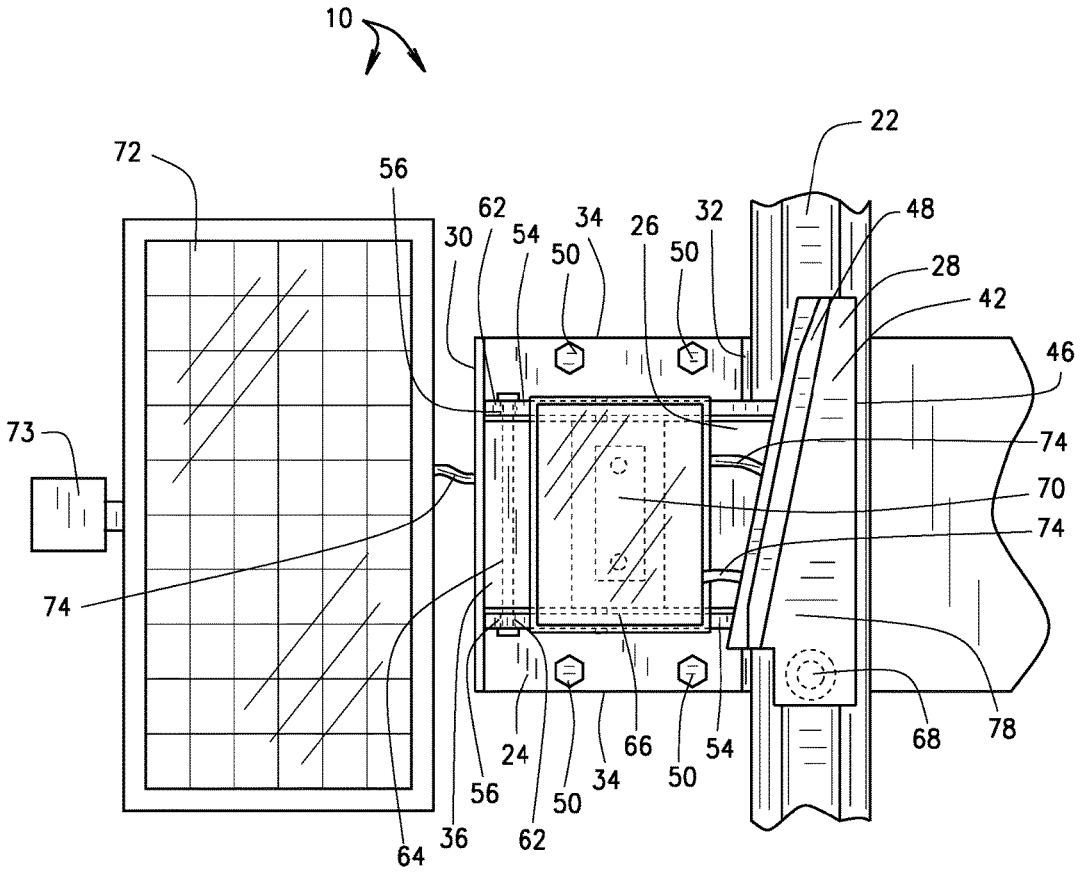
FIG. 2 is a top view of the permanent derailer of FIG. 1, with the wedge rotated to engage the top of the railway track in an "active" (a/k/a "ON" or "DERAILING") position.
Figure 3:
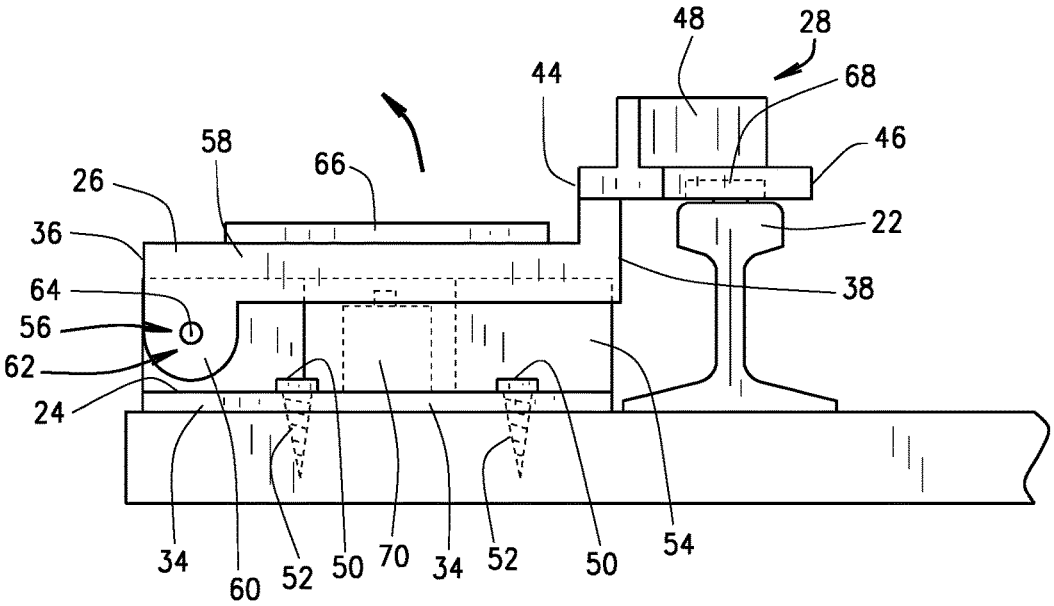
FIG. 3 is a plan view of the rotatable LED and derail wedge components of the permanent derailer of FIG. 1, with the wedge rotated to engage the top of the railway track in an "active" (a/k/a "ON" or "DERAILING") position.
Figure 4:
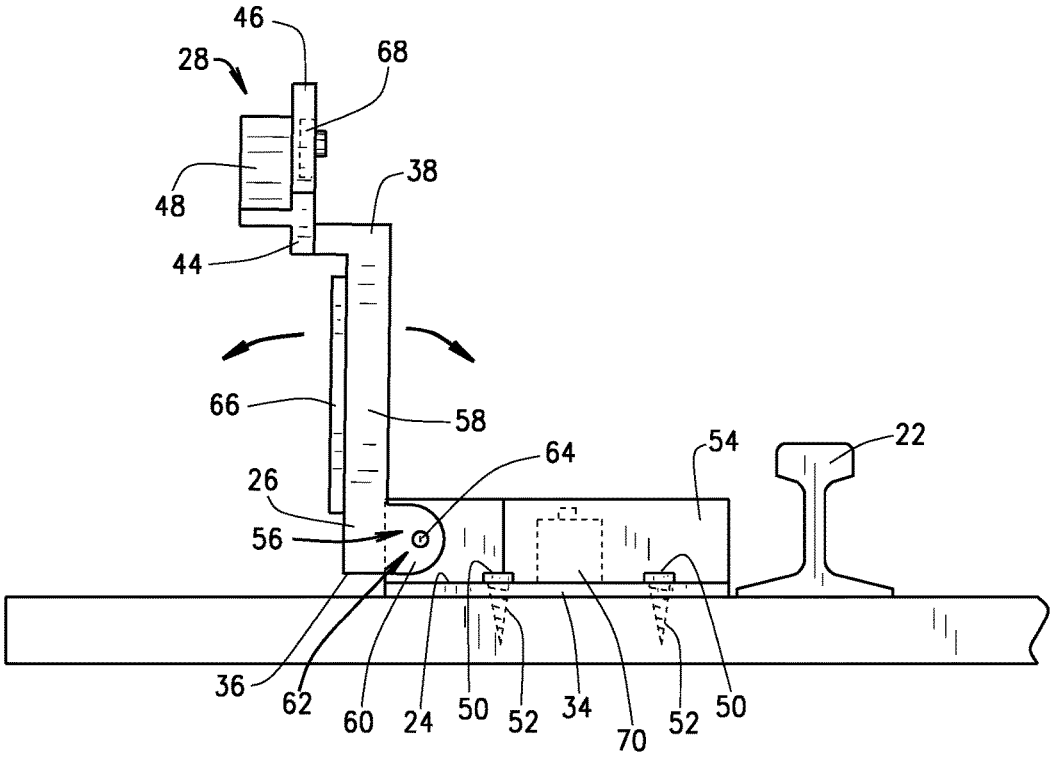
FIG. 4 is a plan view of the rotatable LED and derail wedge components of the permanent derailer of FIG. 1, with the wedge rotated away from railway track in the "inactive" or "OFF" or "NON-DERAILING" position.

The following detailed description illustrates the claimed invention by way of example and not by way of limitation. This description will enable one skilled in the art to make and use the claimed invention, and describes several embodiments, adaptations, variations, alternatives and uses of the claimed invention, including what I presently believe is the best mode of carrying out the claimed invention. Additionally, it is to be understood that the claimed invention is not limited in its application to the details of construction and the arrangements of components set forth in the following description or illustrated in the drawings. Rather, the invention is intended to cover all alternative embodiments and modifications that fall within the spirit and scope of the invention as defined by the claims included herein as well as any equivalents of the disclosed and claimed invention. Hence, the claimed invention is capable of other embodiments and of being practiced or being carried out in various ways. Also, it is to be understood that the phraseology and terminology used herein is for the purpose of description and should not be regarded as limiting.

Turning to the drawings, a first embodiment of the novel derailer placement warning system is shown generally at 10 in FIGS. 1-4 where the present invention is depicted by way of example incorporated into a permanent hinged derailer attached to a section of railway track 22. By way of further example, a second embodiment of the present invention is shown at 100 in FIG. 5 where the invention is incorporated into a portable derailer, a third embodiment where the invention is incorporated into a permanent derailer is shown at 200 in FIG. 6, and a fourth embodiment where the invention is incorporated into a permanent derailer is shown at 300 in FIG. 7. Of course, the present invention can be embodied in other configurations, such as for example incorporated into a slide permanent derailer, or as a kit or an accessory that attaches to or is otherwise used in association with a derailer lacking an incorporated derailer placement warning device of the present invention.

Referring to FIGS. 1-4, it can be seen that the permanent hinged derailer 10 incorporating one embodiment of the novel warning system of this disclosure includes a flat rectangular base plate 24, a flat rectangular neck plate 26 pivotally attached at one end to the base plate 24, and an elongated derail component or wedge 28 attached to the opposite end of the neck plate 26. The base plate 24 has a proximal edge 30, a distal edge 32 and a pair of parallel edges 34 extending between the proximal edge 30 and the distal edge 32. Similarly, the neck plate 26 has a proximal edge 36, a distal edge 38 and a pair of parallel edges 40 extending between the proximal edge 36 and the distal edge 38. The wedge 28 has a flat and rectangular heavy-gage steel foot plate 42 with a proximal edge 44 and a parallel distal edge 46, from which rises perpendicularly upward a heavy-gage steel flange 48. The flange 48 has a uniform height of a few inches and is positioned across the top of the foot plate 42 diagonally relative to the proximal edge 44 and distal edge 46 of the foot plate 42. A set of heavy-gage bolts 50 pass from the top of the base plate 24 through matching bores 52 in the base plate 24 near the parallel edges 34 to secure the base plate 24 to the surface upon which the base plate 24 has been positioned.

A pair of flat, straight flanges 54 rise perpendicularly upward from the base plate 24. The flanges 54 are parallel to each other, parallel to the edges 34 of the base plate 24, and extend from the proximal edge 30 to the distal edge 32 at a distance of a few inches inward from the parallel edges 34. The flanges 54 are uniform in height of approximately one inch, and each has a through bore 56 positioned approximately halfway up from the base plate 24 and approximately one inch from the proximal edge 30 of the base plate 24. The through bores 56 are coaxial and of uniform diameter.

A pair of flat, straight and substantially rectangular flanges 58 drop perpendicularly downward from each of the parallel edges 40 of the neck plate 26. The flanges 58 are parallel to each other and extend along the full length of the neck plate 26. The rectangular sides of the flanges 58 have a uniform height of approximately one inch. A pair of semi-circular tabs 60 extend downward from the ends of each of the flanges 58 proximate to the proximal edge 36 of the neck plate 26. Each of the tabs 60 has a through bore 62 at its center. The through bores 62 are coaxial and equal in diameter to each other and the through bores 56.

The width of the neck plate 26 is slightly greater than the width of the base plate 24, such that flanges 54 nest within the flanges 58, as shown in the Figures. Each of the through bores 56 aligns with its matching through bore 62. A straight pivot pin 64, having a diameters slightly less than the diameter of the through bores 56 and 62, extends through all four of the through bores 56 and 62. In this way, the neck plate 26 and wedge 28 can pivot relative to the base plate 24 about the pivot pin 64 when the pivot pin 64 is positioned in the four through bores 56 and 62.

The base plate 24 of the derailer 10 is shaped and sized to be positioned adjacent a railway track, such as for example the railway track 22 as depicted, or between a set of railway tracks. When the derailer 10 is properly positioned next to a railway track (such as the track 22, as shown in the Figures), the neck plate 26 and by extension the wedge 28 can be rotated about the pivot pin 64 from a first position A in which the wedge 28 rests atop the track 22 (FIGS. 1-3) to multiple other rotational positions in which the wedge 28 does not engage the track 22, such as for example a position B in which the wedge 28 is positioned above the body of the derailer 10 (see FIG. 4). Importantly, when the wedge 28 of the derailer 10 is in position A, or when in a rotational position sufficiently proximate to A, the wedge 28 will face upward and will derail any railway traffic (e.g., a locomotive, rail car, or a caboose) off of the track 22 that passes over the wedge 28—i.e., the "ACTIVE" or "DERAIL" position. The bolts 50 can secure the base 24 to the surface it is resting on to provide stability to the derailer 10 and to maintain the derailer 10 in a consistent location.

The permanent hinged derailer 10 also includes a set of electronic components. An LED panel 66 is fixedly attached to the upper surface of the neck plate 26, a pressure switch 68 attached to the underside of the foot plate 42 of the wedge 28 in a void space 69 shaped and sized to receive at least in part the pressure switch 68. In this way, the pressure switch 68 faces downward such that pressure applied to the switch from below the foot plate 42 (such as when the foot plate 42 is positioned atop a railway rail, such as 22) will trip the switch, an electric storage battery 70 positioned between the base plate 24 and the neck plate 26, and an upwardly facing solar charger 72 attached to a vertical stake 73 that is positioned in proximity to the base 24. The LED panel 66 acts as a warning alert and is configured to emit a sequence of flashing visible light emissions when activated and powered by a sufficient electric current.

Figure 8:
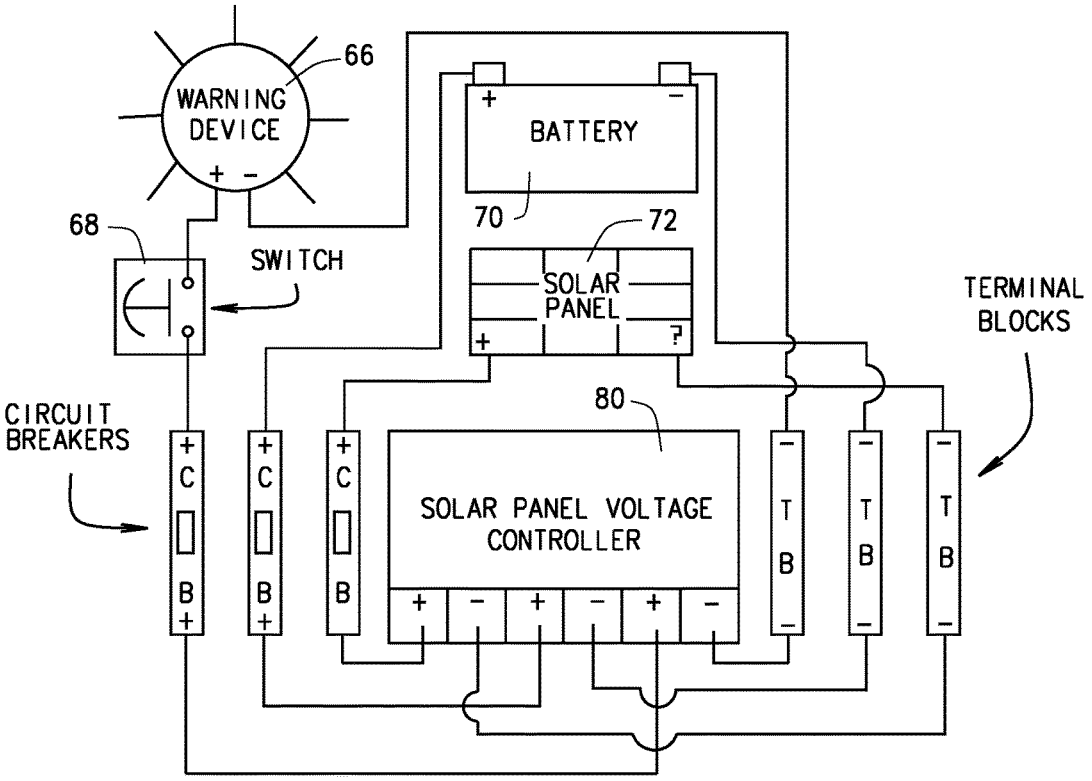
FIG. 8 is a schematic of one embodiment of the electrical circuitry for various embodiments of the derailer of the present disclosure.

The battery 70 is sized to provide sufficient electric current to activate and power the LED panel 66 for a predetermined period of time from full charge without additional charging. The solar charger 72 is sized to provide sufficient electric current to fully charge the battery 70 within a prescribed period of time, and to maintain the battery 70 charge substantially indefinitely with a reasonable amount of average daily sunlight. For purposes of reference, electrical cabling, which is shown generally at 74, interconnects the LED panel 66, the battery 70, the solar charger 72 and the pressure switch 68, so as to effectuate the operation of the warning feature of the derailer 10 as described herein. While one of ordinary skill in the art will recognize that the electrical components of the derailer 10 can be interconnected in multiple ways in order to achieve the operation as disclosed herein, a preferred representative electrical schematic is provided in FIG. 8. It should be noted that in FIG. 8 it can be seen that the electrical components for the derailer 10 preferentially include a solar panel voltage controller 80 that directs the flow of electric current from the solar charger 72 to: (i) the battery 70 to recharge the battery 70 when necessary; (ii) the LED panel 66; or (iii) to both. Of course, voltage controllers are often integrated into solar panels and solar arrays.

The pressure switch 68 is configured to be in the OFF position when not activated (i.e., when no pressure is applied to the switch) which prevents electricity from flowing between the battery 70 and the LED panel 66 so that the LED panel 66 is inactive. However, when the neck plate 26 is rotated about the pivot pin 64 to position A such that the pressure switch 68 on underside of the steel foot plate 42 of the wedge 28 either contacts or is in sufficiently close proximity to the top of the track 22 to activate the switch, the pressure switch 68 turns ON to allow sufficient electric current to flow from the battery 70 to the LED panel 66 to activate and power the LED panel 66. The LED panel 66 then provides an illumination warning signal that the derailer 10 in the "Active" or "ON" or "DERAILING" position relative to the track 22 with the wedge 28 resting atop the track 22 or sufficiently close to the track 22 to derail railway traffic. Conversely, when the neck plate 26 is rotated about the pivot pin 64 such that the pressure switch 68 on the underside of the steel foot plate 42 of the wedge 28 is rotated a distance from the track 22 sufficient to deactivate the switch, the pressure switch 68 turns OFF to stop the flow of electricity from the battery 70 to the LED panel 66 and thereby to deactivate the LED panel 66. In order to extend the duration of this warning signal, the solar charger 72 provides a continuous flow of current to charge the battery 70.

Figure 5:
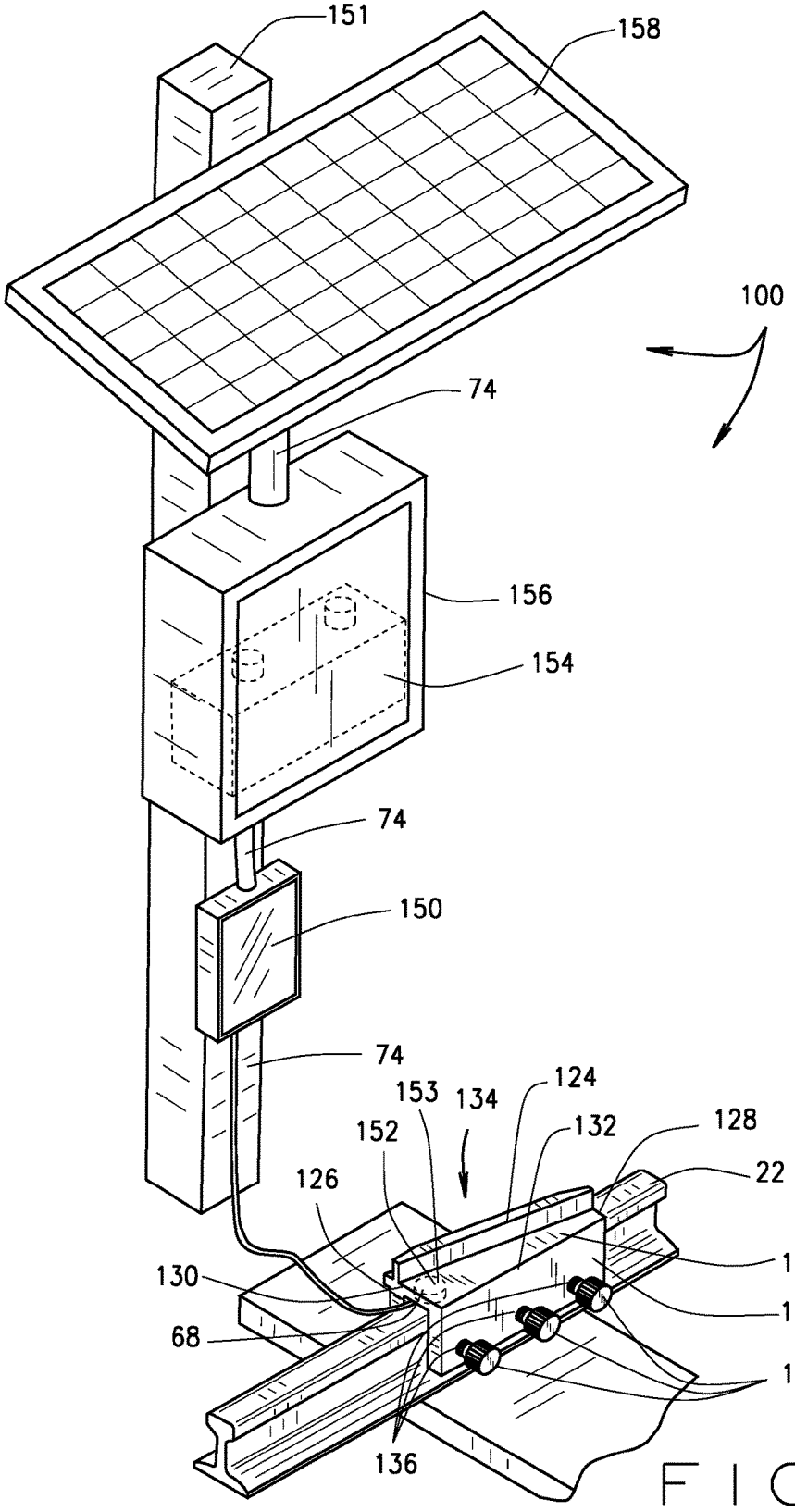
FIG. 5 is a perspective view of a portable derailer positioned atop a section of railway track and incorporating a second embodiment of the present invention, the portable derailer having a proximity sensor opposite the derailing wedge that is engaged with and activated by the top of the railway track in an "active" (a/k/a "ON" or "DERAILING") position, the portable derailer connected by cable to an LED panel and associated solar charging system all mounted on a vertical stake near the derailer.

Referring now to FIG. 5, a second embodiment of the present invention is shown also incorporated into a portable derailer at 100. Here, the portable derailer 100 includes a flat, rectangular heavy-gage steel upper plate 122, a heavy-gage steel derail component or wedge 124 that rises vertically from the top of the upper plate 122, and two parallel, perpendicular heavy-gage steel mounting plates 126 and 127 that extend perpendicularly downward from opposite sides of the upper plate 122. The upper plate 122 has a first short edge 128 and a second short edge 130 that is parallel to the first short edge 128. The upper plate 122 also has a first long edge 132 and a second long edge 134 that is parallel to the first long edge 132.

The mounting plate 126 is welded along its upper edge at a perpendicular angle to the first long edge 132 of the upper plate 122. Similarly, the mounting plate 127 is welded along its upper edge at a perpendicular angle to the second long edge 134 of the upper plate 122. The width of the upper plate 122, i.e., the distance between the first long edge 132 and the second long edge 134, is slightly greater than the width of a single railway track, such as for example the track 22, such that the mounting plates 126 and 127 can both straddle the track 22 when the upper plate 122 is positioned to span across the top of the track 22.

The wedge 124 is straight elongated rectangle, with a uniform height of a few inches above the upper plate 122. The wedge 124 is oriented across the top of the upper plate 122 diagonally relative to the first long edge 132 and the second long edge 134, and stretching from the first short edge 128 to the second short edge 130, such that the wedge 124 substantially crosses the top of the upper plate 122 in a diagonal manner. This insures that any rail traffic passing over the wedge 124 will be diverted off of the track 22.

Each of the mounting plates 126 and 127 has three holes 136 horizontally aligned in series across the center of the plates. For each of the plates 126 and 127, the distance between the holes 136 and the upper edge of the plate must be greater than the thickness of the upper lip of the track 22. A set of heavy-gage bolts 138 mate with and pass through the holes 136 to tighten down against the rib of the track 22 to secure the portable derailer 100 to the track 22. Of course various washers and/or lock washers (not shown) may be placed between the bolts 138 and the mounting plates 126 and 127.

As can be appreciated, the underside of the upper plate 122 should rest atop the track 22 while the mounting plates 126 and 127 are secured to the rib of the track 22 below. Hence, the height of each of the mounting plates 126 and 127 must be sufficient for the plates to drop below the upper lip of the track 22, but not so great that the upper plate 122 is unable to rest atop the track because one or both of the mounting plates rests on the surface next to the track 22.

Like the hinged derailer 10, the portable derailer 100 also includes a set of electronic components. The portable derailer 100 has an LED panel 150 fixedly attached to a large rigid stake 151, a pressure switch 152 attached to the underside of the upper plate 122 in a void space 153 shaped and sized to receive at least in part the pressure switch 152. In this way, the pressure switch 152 faces downward such that sufficient pressure applied to the switch from below the upper plate 122 (such as when the upper plate 122 is positioned atop a railway rail, such as 22) will trip the switch, an electric storage battery 154 positioned in a rectangular housing or box 156 that is attached to the stake 151, and an upward facing solar charger 158 mounted near the top of the stake 151. The stake 151 has a pointed lower end so that it can be driven into the ground in close proximity to the upper plate 122 and mounting plates 126 and 127, when the derailer 100 is positioned on a railway track as shown. Of course the stake 151 can alternately be configured to have a substantially flat base for stability or various latching or fastening devices (not shown) to enable the stake 151 to be attached to particular structures at or near the railway track. The LED panel 150 acts as a warning alert and is configured to emit a sequence of flashing visible light emissions when activated and powered by a sufficient electric current.

The battery 154 is sized to provide sufficient electric current to activate and power the LED panel 150 for a predetermined period of time from full charge without additional charging. The solar charger 158 is sized to provide sufficient electric current to fully charge the battery 154 within a prescribed period of time, and to maintain the battery 154 charge substantially indefinitely with a reasonable amount of average daily sunlight. For purposes of reference, electrical cabling, which is shown generally at 74, interconnects the LED panel 150, the battery 154, the solar charger 158 and the pressure switch 152, so as to effectuate the operation of the warning feature of the derailer 100 as described herein. While one of ordinary skill in the art will recognize that the electrical components of the derailer 100 can be interconnected in multiple ways in order to achieve the operation as disclosed herein, a representative electrical schematic is provided in FIG. 8. It should be noted that in FIG. 8 it can be seen that the electrical components for the derailer 10 preferentially include a solar panel voltage controller 80 that directs the flow of electric current from the solar charger 72 to: (i) the battery 70 to recharge the battery 70 when necessary; (ii) the LED panel 66; or (iii) to both. Of course, voltage controllers are often integrated into solar panels and solar arrays.

The pressure switch 152 is configured to be in the OFF position when not activated (i.e., when no pressure is applied to the switch) which prevents electricity from flowing between the battery 154 and the LED panel 150 so that the LED panel 150 is inactive. However, when the upper plate 122 and mounting plates 126 and 127 of the portable derailer 100 is positioned atop a railway track, such as the track 22, the weight of the plates and the wedge 28 press the pressure switch 152 against the top of the track 22 even when the derailer is not secured to the track 22, which triggers the switch into the ON position to allow sufficient electric current to flow from the battery 154 to the LED panel 150 to activate and power the LED panel 150. When the upper plate 122 and mounting plates 126 and 127 of the derailer 100 are removed from the top of the track 22, the weight of those components will no longer be pressing the pressure switch 152 against the top of the track 22 and the pressure switch 152 returns to the OFF position, which deactivates the LED panel 150. In order to extend the duration of this warning signal, the solar charger 158 provides a continuous flow of current to charge the battery 154.

Figure 6:
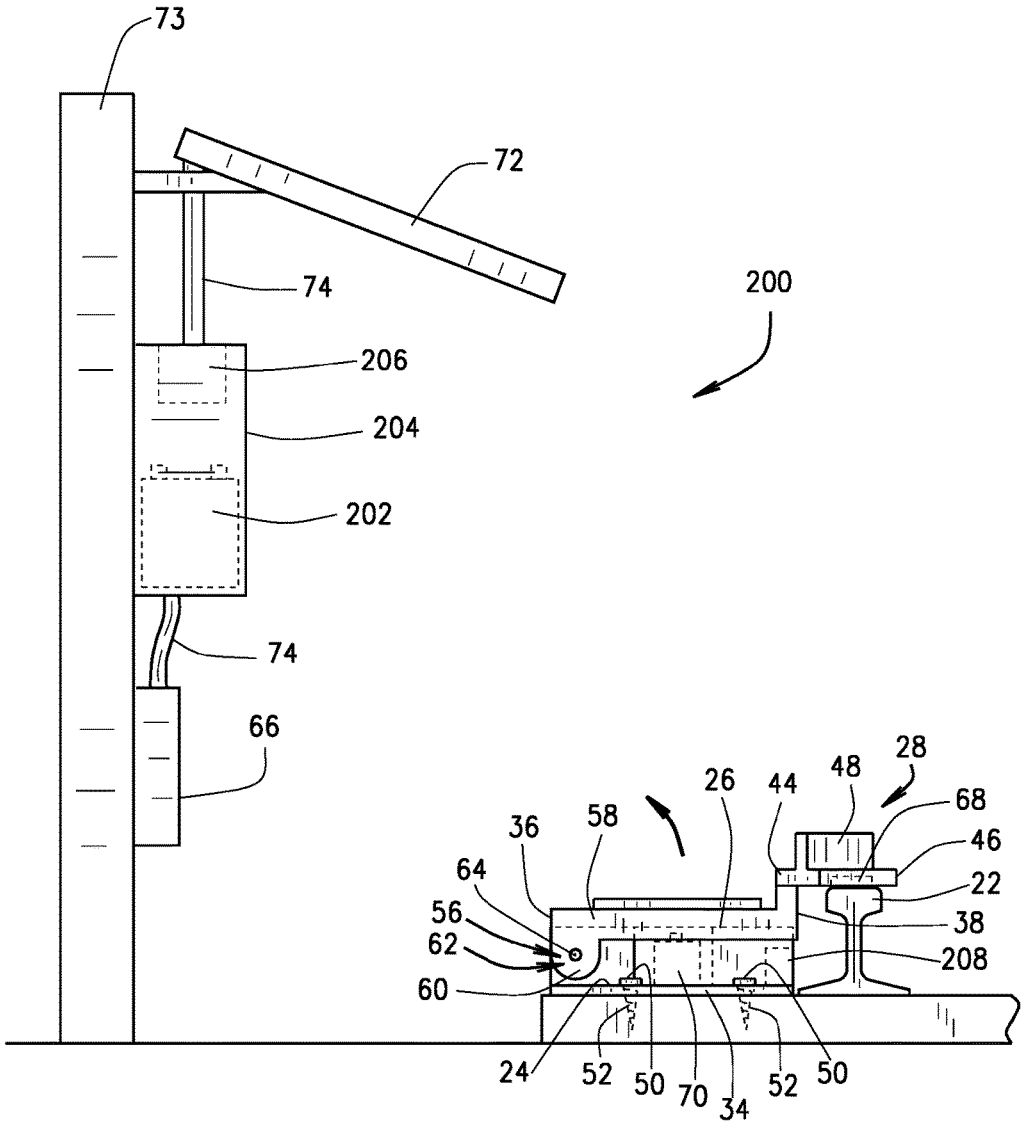
FIG. 6 is a plan view of a permanent derailer positioned adjacent a section of railway and track incorporating a third embodiment of the present invention, the derailer having an LED panel on a rotatable derail wedge with a wireless transmitter under the wedge, the wireless transmitter transmitting a signal indicative of the active or inactive state of the derailer to a nearby wireless receiver attached to a solar charging system, as shown the wedge is rotated to engaged the top of the railway track in an "active" (a/k/a "ON" or "DERAILING") position.

Referring now to FIG. 6, a third embodiment of the present invention is shown also incorporated into a permanent derailer at 200. Here, as can be seen by comparing FIG. 5 to FIG. 1, the derailer 200 incorporates most of the same components as the derailer 10. However, for the derailer 200, the LED panel 66 is fixedly attached to the side of the stake 73 instead of being fixedly attached to the upper surface of the neck plate 26. Also, the derailer 200 has a battery 202 positioned within a housing 204 that is also fixedly attached to the side of the stake 73. Electric cables (shown in part at 74) interconnect the battery 202 a wireless receiver 206 also positioned within the housing 204, the solar charger 72, and the LED panel 66, such that the solar charger 72 maintains an electric charge in the battery 202 and the solar charger 72 and the battery 202 can independently or collectively power the wireless receiver 206 and the LED panel 66. While one of ordinary skill in the art will recognize that the electrical components of the derailer 100 can be interconnected in multiple ways in order to achieve the operation as disclosed herein, a representative electrical schematic is provided in FIG. 9. It should be noted that in FIG. 9 it can be seen that the electrical components for the derailer 10 preferentially include a solar panel voltage controller 80 that directs the flow of electric current from the solar charger 72 to: (i) the battery 70 to recharge the battery 70 when necessary; (ii) the LED panel 66; (iii) the wireless receiver 206; or (iii) any combination of the three as demanded by the voltage level of the battery 70 and the voltage being generated by the solar charger 72. Of course, voltage controllers are often integrated into solar panels and solar arrays.

The derailer 200 also has a wireless transmitter 208 positioned in proximity to and connected to the battery 70 and the pressure switch 68 such that when the neck plate 26 is rotated about the pivot pin 64 to position A such that the pressure switch 68 on underside of the steel foot plate 42 of the wedge 28 either contacts or is in sufficiently close proximity to the top of the track 22 to activate the switch, the pressure switch 68 turns ON to allow sufficient electric current to flow from the battery 70 to the wireless transmitter 208 to generate a wireless signal that is received by the wireless receiver 206, which in turn, allows electricity to run from the battery 202 and solar charger 72 to the LED panel 66 to activate and power the LED panel 66. The LED panel 66 then provides an illumination warning signal that the derailer 10 in the "Active" or "ON" or "DERAILING" position relative to the track 22 with the wedge 28 resting atop the track 22 or sufficiently close to the track 22 to derail railway traffic. Conversely, when the neck plate 26 is rotated about the pivot pin 64 such that the pressure switch 68 on the underside of the steel foot plate 42 of the wedge 28 is rotated a distance from the track 22 sufficient to deactivate the switch, the pressure switch 68 turns OFF to stop the flow of electricity from the battery 70 to the wireless transmitter 206, which ceases generating the wireless signal to the wireless receiver 204, which then halts the flow of electricity from the battery 202 and the solar charger 72 and thereby to deactivates the LED panel 66.

Figure 7:
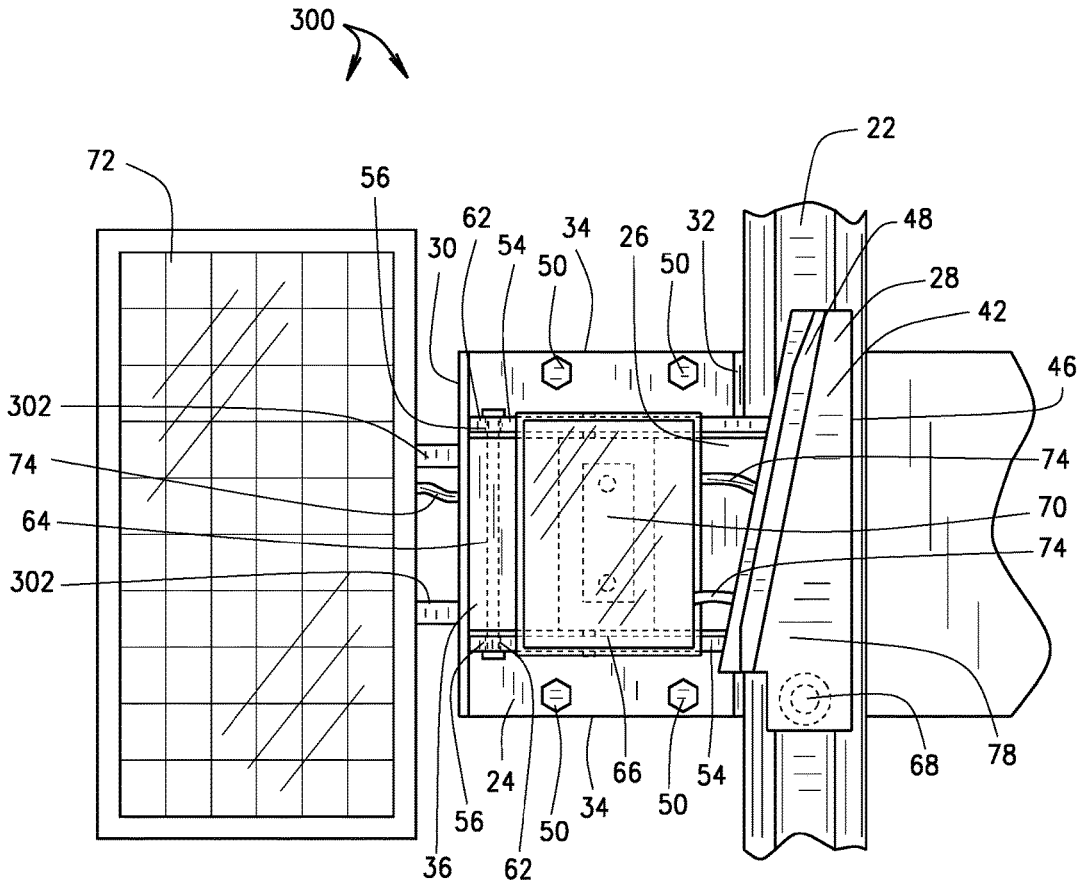
FIG. 7 is a top view of a permanent derailer positioned adjacent a section of railway track and incorporating a fourth embodiment of the present invention, the derailer having an LED panel on a rotatable derail wedge, the LED panel being connected to a solar charging system fixedly attached to the end of the wedge, the wedge shown rotated to engaged the top of the railway track in an "active" (a/k/a "ON" or "DERAILING") position.

Referring now to FIG. 7, a fourth embodiment of the present invention is shown also incorporated into a permanent derailer at 300. Here, as can be seen by comparing FIG. 5 to FIG. 1, the derailer 300 incorporates most of the same components as the derailer 10. However, for the derailer 300, the solar charger 72 is fixedly attached in an upward facing manner by a pair of arms 302 to the proximal end 30 of the base plate 24.

While I have described in the detailed description several configurations that may be encompassed within the disclosed embodiments of this invention, numerous other alternative configurations, that would now be apparent to one of ordinary skill in the art, may be designed and constructed within the bounds of my invention as set forth in the claims. Moreover, the above-described novel derailer placement warning device of the present invention can be arranged in a number of other and related varieties of configurations without departing from or expanding beyond the scope of my invention as set forth in the claims.

For example, in yet other embodiments (not shown), the novel warning system of the present disclosure can be configured as an electro-mechanical kit or accessory that is attached to a derailer, either portable or permanent, to provide the derailer with an automated warning system that alerts railway personnel that the derailer is positioned to derail railway traffic. Such embodiments include, by way of example, the same set of electronic components wired in the same way as shown, by way of example, in FIGS. 8 and 9 for a permanent hinged derailer (i.e., an LED panel, such as at 66, a pressure switch, such as at 68, attached to the underside of the derailer wedge and facing downward such that pressure applied to the switch from below the wedge will trip the switch, an electric storage battery, such as at 70, and a solar charger, such as at 72), and the same set of electronic components wired in the same way as shown, by way of example, in FIGS. 8 and 9 for a portable derailer (an LED panel, such as at 150, a pressure switch, such as at 152, attached to the underside of the derailer, an electric storage battery, such as at 154, and a solar charger, such as at 158). However it will be appreciated that the kit and accessory embodiments of the present invention will likely include components configured with adaptable or custom-fitted hooks, fasteners and shapes designed to properly attach to the desired permanent or portable derailer.

In addition, it is not necessary that the switch 68 be pressure activated. Rather, the switch 68 may alternately be any of a variety of switch types, including for example, an optical sensor switch, a magnetic sensor switch, a haptic or tactile sensor switch, or an electric switch, each of varying shapes and sizes and types, so long as the switch can control the flow of electric current between the battery 70 and the warning alert (e.g., the LED panel 66) when the wedge 28 is resting atop or in near proximity to the track 22 in such a manner that the wedge 28 will derail railway traffic that passes past the derailer 10. Similarly, the switch 152 may alternately be any of a variety of switch types, including for example, an optical sensor switch, a magnetic sensor switch or an electric switch. In addition, the warning system can include additional switches to directly or remotely enable or disable the alert.

The automated warning system of the present disclosure can be configured for incorporation into virtually any type of derailer, whether portable or permanent, including for example slide derailers, so long as the modified derailer meets the requirements of this disclosure to automatically provide a warning or alert to railway personnel or others when the derailer is positioned to derail railway traffic.

Figure 9:
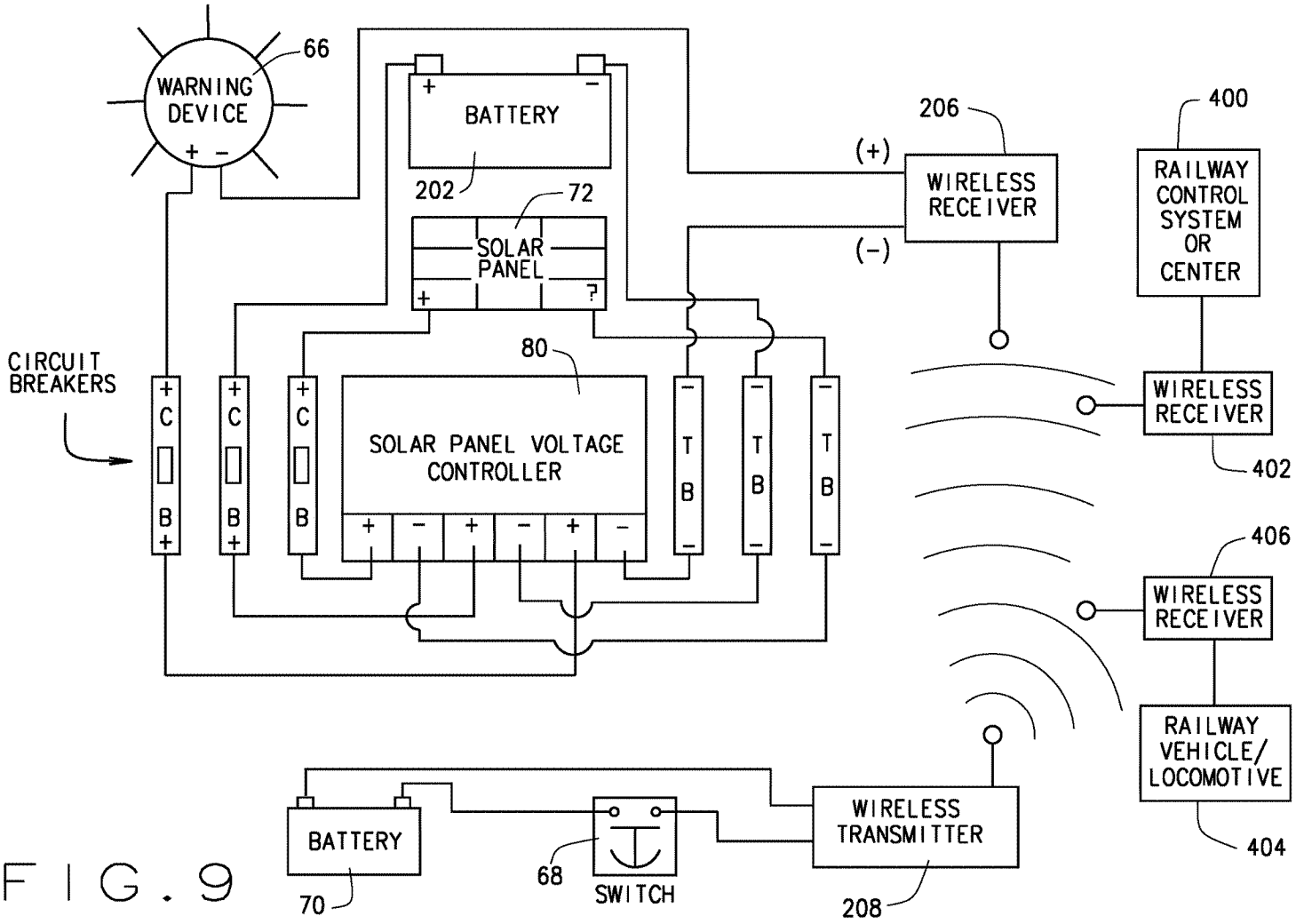
FIG. 9 is a schematic of a second embodiment of the electrical circuitry for various embodiments of the derailer of the present disclosure.

The warning system can also be configured to communicate its condition or state, and transmit any warning or alert, to a remote center, such as for example a railway control center or hub 400 (see FIG. 9), or for example to a communications systems in a railway vehicle such as a locomotive 404. Such remote communications can be accomplished either through hard wiring or through wireless transmission, such as the wireless receivers 402 and 406 (FIG. 9).

Moreover, the present novel derailer placement warning device is not limited to the use of an LED panel, a specific number of LED lights, or even LED lights themselves, as alerts. Rather, the warning alerts can comprise various other forms of alerts, such as for example, various types of lights (including for example, incandescent, neon, and mercury vapor), visual devices such as flags, visual effects such as smoke release devices, olfactory components, wireless transmitters and/or audio devices such as horns, buzzers or alarms, or any combination of two or more such devices.

Further, the novel derailer placement warning device can be configured without a battery, so long as the device is capable of automatically generating an alarm that alerts railway personnel or others that the derailer is positioned to derail railway traffic. However, for configurations that require an electric current, the device can be attached to a power source, such as for example an AC power circuit or line, a panel of solar cells without a battery, or a lone battery instead of a pack of batteries.

In addition, the various electrical components of the derailers 10, 100, 200 and 300 as shown in the Figures can be reconfigured such that any one or more of the electrical components may be attached to the respective derailer, or alternately positioned independently at or near the respective derailer, or alternately positioned in a separated group or cluster as depicted by way of example in FIG. 5 for the derailer 100.

Further, the novel derailer placement warning device can be configured to control the type of signal generated by the alert. That is, the LED lights can for example be controlled to illuminate in various patterns with controllable timing and brightness. Similarly, the novel derailer placement warning device can be configured to control audio-type alarms for example as to timing, pitch, duration, patterns and volume.

A control circuit can also be added to the warning device to interface with and control the various electrical components. That is, some or all of the electrical components can be wired into a main control panel that operates the warning device. Moreover, the control circuit can also include a microprocessor with computer software that enables the user to implement any one or more of a variety of controls over the warning device, including for example, a controllable timer, a pattern generator for the alert, a daylight sensor and switch, a hard-wire or wireless transmitter to communicate the condition of the alert to a distal receiver or warning panel, or an interface to accept manual instructions or overrides.

Additional variations or modifications to the configuration of the novel derailer placement warning device of the present invention may occur to those skilled in the art upon reviewing the subject matter of this invention. Such variations, if within the spirit of this disclosure, are intended to be encompassed within the scope of this invention. The description of the embodiments as set forth herein, and as shown in the drawings, is provided for illustrative purposes only and, unless otherwise expressly set forth, is not intended to limit the scope of the claims, which set forth the metes and bounds of my invention.

What is claimed is:

1. An automated warning system for the placement of a railway derailer on a rail of a railway, the derailer comprising an underside that engages at least in part the railway rail when the derailer is positioned on the railway rail, the derailer comprising a derail component that derails railway traffic passing at least in part over the derailer, the derail component defining an engagement surface on said derailer where railway traffic engages at least in part the derailer to derail the railway traffic, the derail component defining a safe zone on said derailer where railway traffic does not engage the derailer, the warning system comprising an electronic circuit having an electric power source, an electronic switch and an electronic alert; said switch having an ON state in which the electric power source activates the alert to generate a warning signal and an OFF state in which the electric power source does not activate the alert; the switch being positioned on or along the underside of the derailer such that the switch assumes the ON state when the derailer is positioned at least in part on the railway rail, one of said electronic switch, said electric power source and said electronic alert being separated from the engagement surface.

2. The automated warning system of claim 1, wherein the electronic alert comprises a light emitting diode and the warning signal comprises light emitted from the light emitting diode.

3. The automated warning system of claim 1, further comprising an electronic transmitter, said electronic transmitter communicating the warning signal to an electronic receiver.

4. The automated warning system of claim 1, wherein the switch is positioned on the derailer so as to assume the OFF state when the derailer is not at least in part positioned on the railway rail.

5. The automated warning system of claim 1, wherein the electric power source comprises a battery or a solar energy device.

6. The automated warning system of claim 1, wherein the switch attaches to the derailer.

7. The automated warning system of claim 1, wherein the switch comprises a proximity sensor or a pressure sensor.

8. An auto-alert portable derailer for a railway rail, the portable derailer automatically warning of the placement of the portable derailer on the railway rail, the portable derailer comprising:

a. a fastener adapted to releasably engage the derailer with the railway rail;

b. an upperside generally facing upward when the derailer is positioned on the railway rail;

c. an underside generally facing away from the upperside;

d. a derail component extending from the upperside of the derailer, the derail component having a derail surface, the derail component derailing railway wheels passing at least in part over the derail surface when the derailer is positioned on the railway rail; and e. an electronic circuit having an electric power source, an electronic switch and an electronic alert; said switch having an ON state in which the electric power source activates the alert to generate a warning signal and an OFF state in which the electric power source does not activate the alert; the switch being disposed on or along the underside of the derailer such that the switch assumes the ON state when the derailer engages the railway rail, one or more of said electric power source, said electronic switch and said electronic alert being separated from the derail surface.

9. The auto-alert portable derailer of claim 8, wherein the alert comprises a light emitting diode and the warning signal comprises light emitted from the light emitting diode.

10. The auto-alert portable derailer of claim 8, wherein the alert communicates the warning signal to an electronic receiver.

11. The auto-alert portable derailer of claim 10, further comprising a wireless transmitter, the electronic receiver comprising a wireless receiver, the wireless transmitter wirelessly communicating the warning signal to the wireless receiver.

12. The auto-alert portable derailer of claim 8, wherein the switch is oriented relative to the derail component so as to assume the OFF state when the derail component is not engaged with the railway rail.

13. The auto-alert portable derailer of claim 8, wherein the derail component pivots or slides relative to the body.

14. The auto-alert portable derailer of claim 8, wherein the switch comprises a proximity sensor or a pressure sensor.

15. The automated warning device of claim 1, wherein the warning signal comprises one or more of an audible component, a tactile sensation, an olfactory component, a visible light emission, and an electronic transmission.

16. The automated warning device of claim 3, wherein the electronic receiver is operatively associated with a railway control system, the electronic receiver communicating the warning signal to the railway control system when the electronic transmitter communicates the warning signal to the electronic receiver.

17. The auto-alert portable derailer of claim 8, wherein the underside of the portable derailer defines a void space between the derailer and the railway rail when the derailer is engaged with the railway rail, said void space being shaped and sized to receive at least in part the switch.

18. The auto-alert portable derailer of claim 17, wherein the void space is shaped and sized relative to the switch such that when the switch is positioned in the void space and the derailer is engaged with the railway rail, the switch will properly operate before and after railway traffic passes over the derail component.

19. The auto-alert portable derailer of claim 8, wherein the derail component comprises a flange, said flange extending upward from the upperside of the derailer and defining a separation between the derail surface and a safe zone on the upperside opposite the derail surface where railway traffic will not engage the derailer, one or more of said electric power source, said electronic switch and said electronic alert being positioned in said safe zone.

20. The auto-alert portable derailer of claim 19, wherein said electric power source and said electronic alert are positioned in said safe zone.

21. The auto-alert portable derailer of claim 10, wherein the receiver is operatively associated with a railway control system, the receiver communicating the warning signal to the railway control system.

22. The auto-alert portable derailer of claim 8, wherein the warning signal comprises one or more of an audible component, a tactile sensation, an olfactory component, a visible light emission, and a wireless transmission.

23. The auto-alert portable derailer of claim 8, wherein the electric power source comprises a battery or a solar energy device.

24. The auto-alert portable derailer of claim 8, wherein the warning signal is intermittent.

25. An auto-alert permanent derailer for a railway rail, the permanent derailer automatically warning of the derailer's engagement with the railway rail, the permanent derailer comprising:

a. a body adapted for placement adjacent the railway rail;

b. a derail component operatively associated with the body, the derail component being selectively movable between a first position in which the derail component at least in part engages the railway rail and a second position in which the derail component does not engage the railway rail when the body is positioned adjacent the railway rail, the derail component derailing railway traffic that passes over the derail component when the derail component is in the first position, the derail component having an underside generally facing the railway rail when the derail component is in the first position; and c. an electronic circuit having an electric power source, an electronic switch and an electronic alert; said switch having an ON state in which the electric power source activates the alert to generate a warning signal and an OFF state in which the electric power source does not activate the alert; the switch being disposed on or along the underside of the derailer such that the switch assumes the ON state when the derail component is in the first position.

26. The auto-alert permanent derailer of claim 25, further comprising an electronic transmitter and an electronic receiver, said electronic transmitter communicating the warning signal to said electronic receiver.

27. The auto-alert permanent derailer of claim 25, wherein the switch assumes the OFF state when the derail component is in the second position.

28. The automated warning device of claim 25, wherein the derail component defines a void space between the derailer component and the railway rail when the derail component is engaged with the derail rail, said void space being shaped and sized to receive at least in part the switch.

29. The automated warning device of claim 26, wherein the electronic receiver is operatively associated with a railway control system, the electronic receiver communicating the warning signal to the railway control system.

* * * * *